United States Patent [19]

Funahashi et al.

[11] Patent Number: 5,075,899

[45] Date of Patent: Dec. 31, 1991

[54] BALL-CATCHING GLOVE FOR USE IN BASEBALL AND SOFTBALL

[75] Inventors: Hisanobu Funahashi; Kazuhiro Kume; Toshiaki Nishimura, all of Osaka, Japan

[73] Assignee: Mizuno Corporation, Osaka, Japan

[21] Appl. No.: 554,521

[22] Filed: Jul. 20, 1990

[30] Foreign Application Priority Data

Jul. 21, 1989 [JP] Japan ..... 1-86128[U]

[51] Int. Cl.[5] ..... A41D 13/10

[52] U.S. Cl. ..... 2/19

[58] Field of Search ..... 2/16, 19, 161 A, 255

[56] References Cited

U.S. PATENT DOCUMENTS

| | | | |
|---|---|---|---|
| 2,528,802 | 11/1950 | Turner | 2/19 |
| 2,988,744 | 6/1961 | Stobbe | 2/19 |
| 3,918,096 | 11/1975 | Lim | 2/161 A |
| 4,272,849 | 6/1981 | Thurston et al. | 2/16 |
| 4,477,927 | 10/1984 | Tsubota et al. | 2/19 |
| 4,483,022 | 11/1984 | Aoki | 2/19 |
| 4,688,269 | 8/1987 | Maeshima | 2/16 |
| 4,768,234 | 9/1988 | Yamamoto | 2/161 A |
| 4,810,559 | 3/1989 | Fortier et al. | 2/161 A |

FOREIGN PATENT DOCUMENTS

| | | | |
|---|---|---|---|
| 3519633 | 12/1986 | Fed. Rep. of Germany | 2/161 A |
| 1556357 | 11/1979 | United Kingdom | 2/16 |

*Primary Examiner*—Werner H. Schroeder
*Assistant Examiner*—Michael A. Neas
*Attorney, Agent, or Firm*—Fleit, Jacobson, Cohn, Price, Holman & Stern

[57] ABSTRACT

A ball-catching glove for use in baseball and softball. A hollow glove body has a ball-catching palm portion and a rear portion comprising a bilayer structure having inner and outer layers of leather. A plurality of shape-retaining members, which are made of a suitable material such as a synthetic resin or an elastomer, are integrally secured on the outer surface of the rear portion, while reinforcing members are interposed between that outer surface and the shape-retaining members. Further, a plurality of buffer members are disposed between the inner and outer layers of leather. This arrangement renders the ball-catching glove free from deformation, and capable of effectively protecting the user's hand.

3 Claims, 2 Drawing Sheets

BALL-CATCHING GLOVE FOR USE IN BASEBALL AND SOFTBALL

BACKGROUND OF THE INVENTION

The present invention relates to a ball-catching glove suitable for use in baseball or softball games.

In conventional ball-catching gloves of this type, a ball-catching, palm portion is made of a natural leather such as cowhide, and a rear portion is either made of a natural leather, such as above, or a synthetic leather and joined to the palm portion to form a body. A core made of felt or the like is built inside the glove at a desired position. Hitherto, various proposals have been made in order to prevent deformation of the glove after repeated use in ball-catching actions and to protect the user from injuries such as finger sprains.

For instance, Japanese Utility Model Publication No. 8931/1955 has been proposed to prevent the risk of glove deformation or a finger sprain by the following structure. Elastic members, such as pieces of flat steel wire, are inserted into wrapping portions formed on the rear side of the glove by utilizing the layer of leather forming the rear surface of the body. The elastic members are completely wrapped in the portions and held in place by sewing the wrapping portions.

Japanese Utility Model Publication No. 25330/1980 has been proposed to prevent the similar disadvantages by providing tape-shaped bags of suitable widths and reinforcing them by placing therein plate members, such as thin metal sheets, which have sheath elasticity.

The structure in which elastic members such as flat steel wires are inserted in the wrapping portions serves to provide tensile force. However, the structure provides only inferior shape retaining ability which is not good enough to prevent deformation. This was why the second proposal was made, in which the plate members having elasticity are placed in the tape-shaped bags.

The second proposal, however, has a disadvantage in that the process of sewing the tape-shaped bags onto the body is necessary. In addition, there is the risk that, after the ball-catching glove has been repeatedly bent during use, edge portions of the plate members may break through the bags. Particularly, when metal sheets are used as the plate members, after repeated bending of the glove the members may become plasticly-deformed. In such cases, the glove may become deformed into an incorrect shape and can not be straightened easily.

SUMMARY OF THE INVENTION

In view of the above-described problems of the prior art, it is an object of the present invention to reinforce the rear portion of a ball-catching glove with a synthetic resin material which rarely suffers from plastic deformation, so as to prevent glove deformation and finger sprains, as well as to protect the user's hand in the event of violent collision.

According to the present invention, there is provided a ball-catching glove for use in baseball and softball comprising: a hollow body having a ball-catching palm portion and a rear portion, each of the palm and rear portions having inner layer and outer layer of leather and a plurality of shape-retaining members integrally secured on the outer surface of the rear portion at suitable positions. The shape-retaining members are made of a suitable material, such as a synthetic resin or an elastomer, which has a higher rigidity than the material forming the rear portion.

The shape-retaining members may be secured on the following methods. Before the rear portion is sewn, the shape-retaining members may be injection molded onto the outer surface of the rear portion, simultaneously and integrally. Alternatively, the shape-retaining members may be separately molded, and then secured onto that surface by bonding and sewing.

According to the present invention, on the outer surface of the rear portion at positions which correspond to the finger sacks in the body of the glove, a plurality of reinforcing members may be disposed so that the shape-retaining members are integrally secured on that surface with the reinforcing members. The reinforcing members are made of a material having a higher rigidity and hardness than the material forming the shape-retaining members, such as, for example a stampable sheet. This sheet may be for example, a fiber-reinforced thermoplastic (FRTP) sheet with a cloth or mat base, an FRTP sheet composed of short fiber, a fiber-reinforced plastic (FRP) sheet, or plastic. In addition, a plurality of buffer members of, for example, a synthetic resin foam or the like, may be interposed between the inner and outer layers of leather of the rear portion.

When reinforcing members are to be formed as hybrid products including stampable sheets, it is possible to insert-mold the reinforcing members during the molding of shape-retaining members if the matrix resin used is a synthetic resin of the same type as that forming the shape-retaining members. This is meritorious in reducing production cost and achieving good bonding.

Thus, in a ball-catching glove according to the present invention, since shape-retaining members, which are either members made of a highly rigid synthetic resin or elastomer, or members consisting of hybrid products with reinforcing members, are integrally secured on the surface of a rear portion including inner and outer layers, the shape-retaining members serve to retain the shape of the glove as desired, and eliminate the risk of deformation of the glove even after repeated ball-catching.

For instance, if the body of the glove is made to be curved into a shape which facilitates the catching of a ball, and the shape-retaining members are secured on the surface of the rear portion, the glove is capable of maintaining its original shape without any deformation. If the finger sacks in the body are made so as to maintain their position in accordance with a given to sectional configuration of the fingers, and if the shape-retaining members are secured on the surface of the rear surface portion, the finger sacks are so contoured as to enable smooth insertion and removal of fingers, while the glove is free from deformation. Also, the shape-retaining members serve the function of ribs to prevent backward bending of the body, thereby reducing the risk of finger sprains.

If sheets of a rigid material are interposed between the surface of the rear portion and the shape-retaining members, these sheets serve to prevent backward bending of the body even when a strong force acts on the body when a ball is caught.

The shape-retaining members and the rigid sheets beneath these members act to protect the user's hand particularly when the rear portion of the glove is subjected to a strong impact, for instance, during a touch play by the user, or at collision of the glove against an object such as a fence as a result of the user's running after the ball.

The provision of the buffer members between the inner and outer layers of leather in the rear portion imparts a soft feeling to the user when he has inserted the hand.

Further objects, features and advantages of the present invention will become apparent from the Detailed Description of Preferred Embodiments which follows, when considered together with the attached drawings.

BRIEF DESCRIPTION OF THE DRAWINGS

The drawings show a baseball glove embodying the prevent invention, in which.

DESCRIPTION OF THE PREFERRED EMBODIMENTS

Figure 1:
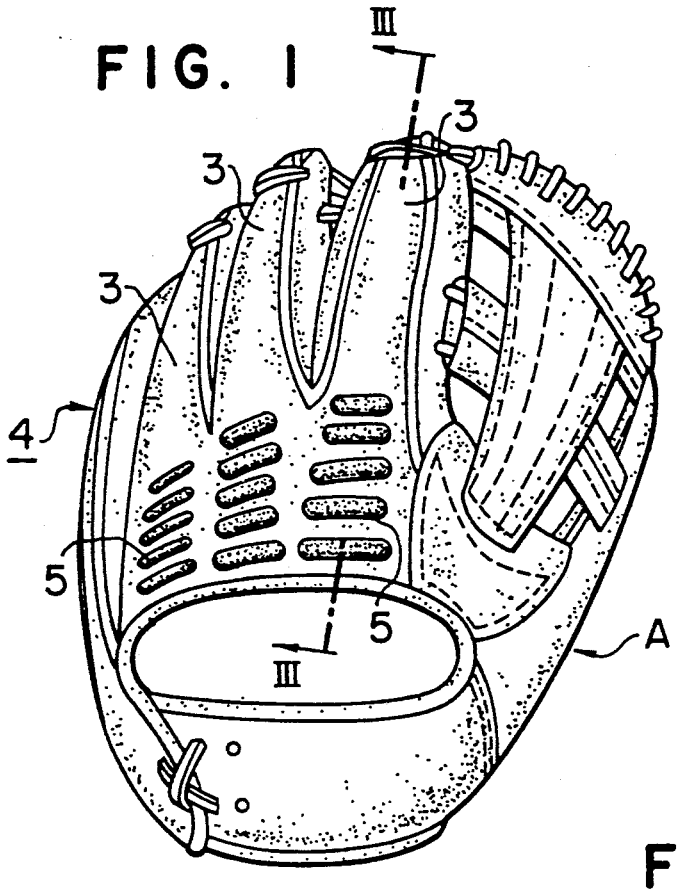
FIG. 1 is a rear elevation of the glove.
Figure 2:
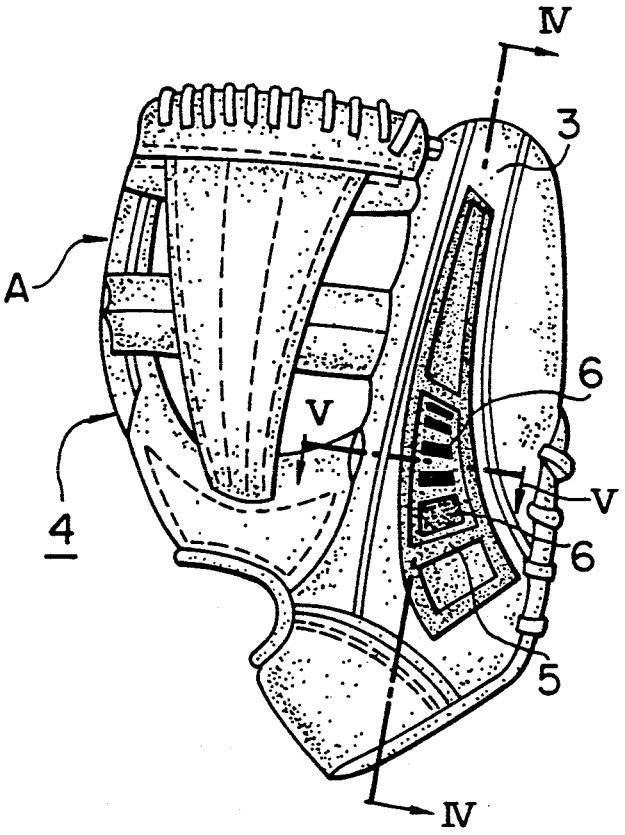
FIG. 2 is a side elevation of the glove, taken from the side of the thumb sack of the glove.
Figure 3:
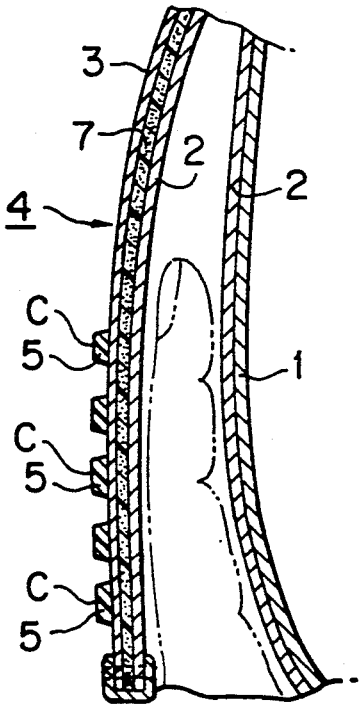
FIG. 3 is a section taken along the line III—III shown in FIG. 1.
Figure 4:
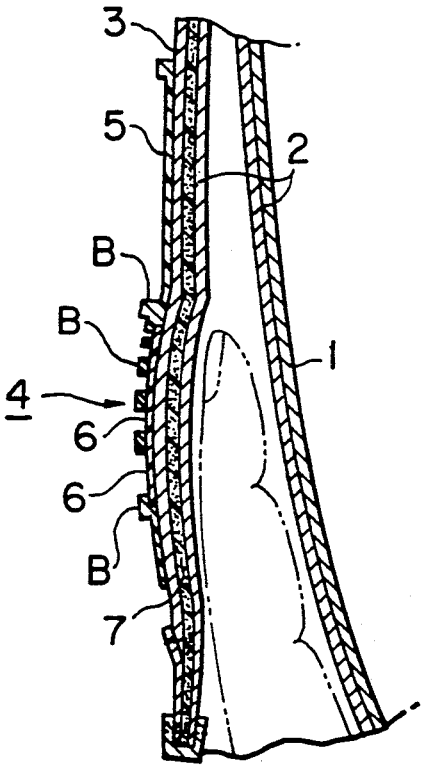
FIG. 4 is a section taken along the line IV—IV shown in FIG. 2.
Figure 5:
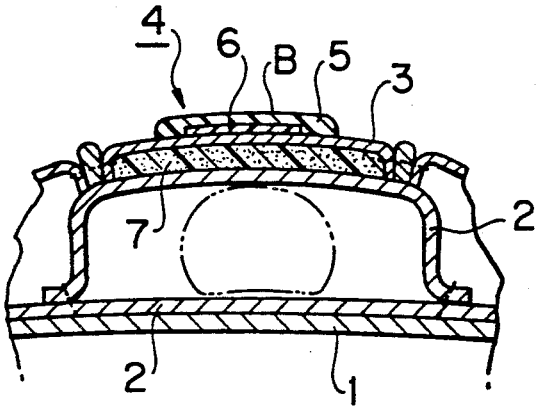
FIG. 5 is a section taken along the line V—V shown in FIG. 2.

A ball-catching glove for use in baseball and softball according to the present invention will be described with reference to the drawings illustrating a baseball glove.

A ball-catching glove has a hollow body A which is formed by a ball-catching palm portion including outer and inner layers 1 and 2 of leather, and a rear portion 4 including inner and outer layers 1 and 3 of leather. The glove is a baseball glove having a plurality of shape-retaining members 5 integrally secured on the outer surface of the rear portion 4 and made of a highly rigid synthetic resin or an elastomer. Preferably, the shape-retaining members 5 are in the form of ribs B which extend either continuously or discontinuously, and in the form of ridges C which may be either continuous or discontinuous.

In a preferred embodiment, the baseball glove also has reinforcing members 6 made of a material having higher rigidity and hardness than the shape-retaining members 5, such as stampable sheets. The member 6 are interposed between the outer surface of the rear portion 4 and the shape-retaining members 5 so that the members 5 are integrally secured on that surface with the reinforcing members 6 therebetween. In the drawings, the reinforcing member 6 is located below the those shape-retaining members 5 at the position of the thumb sack. One may freely determine whether or not to provide further reinforcing members at any of the other finger sacks.

Preferably, buffer members 7 are partially or wholly disposed between the inner and outer layers 2 and 3 of leather of the rear portion 4.

The shape-retaining members are secured to the outer surface of the rear portion either directly or indirectly by means of the reinforcing members at desired positions of that surface, after the body A has been given the shape that is optimum for catching a ball. The glove is thus capable of maintaining its original shape for a long period of time, and is free from deformation even after repeated use in ball-catching actions. Thus, the catching of a ball is facilitated.

The shape-retaining members serve a rib-like function to prevent backward bending of the ball-catching glove. This enables the prevention of injuries such as finger sprains. In particular, if the shape-retaining members are in the form of ribs or in the form of ridges which are either continuous or discontinuous, this provides the following advantage. When a ball is caught the ribs and the ridges exhibit relatively strong resistance to bending, while the spaces between the ribs and between the ridges exhibit relatively weak resistance. The result is that the force imparted to the glove upon catching a ball causes the glove to be naturally bent toward the ball-catching plam surface. Thus, the provision of the shape-retaining does not hinder the user in catching a ball.

Another advantage is that, when the rear portion of the glove is brought into violent collision with an object such as a fence while a user is in chase of the ball, or when that portion of the glove is subjected to an impact by the user in a touch play, the shape-retaining members act as a buffer means to protect the user's hand from an injury. The buffer effect is particularly remarkable at the locations where the sheets of a rigid material are interposed between the shape-retaining members and the outer surface of the rear portion, and the locations where the buffer members are inserted.

In brief, the ball-catching glove according to the present invention is capable of preventing glove deformation and finger sprains, as well as of protecting the user's hand in the event of violent collision.

While the present invention has been described in terms of several preferred cmbodiments, one of ordinary skin in the art will recognize that modifications and improvements are possible within the scope of the present invention which is determined soley by the appended claims.

What is claimed is:

1. A ball-catching glove comprising:

a hollow body having a ball-catching palm portion and a rear portion; and a plurality of shape-retaining members integrally secured on the outer surface of said rear portion at suitable positions thereof, said shape-retaining members being made of a synthetic-resin material sufficiently resilient to maintain the shape of the glove;

a reinforcing member interposed between the outer surface of said rear portion and the shape-retaining members to prevent the glove from bending backwards when catching the ball.

2. A ball-catching glove according to claim 1, wherein said rear portion, comprises a bilayer structure having inner and outer layers of leather, said glove further comprising a plurality of buffer members at least partially disposed between said layers.

3. A ball-catching glove comprising:

a hollow body having a ball-catching palm portion and a rear portion; and a plurality of shape-retaining members integrally secured on the outer surface of said rear portion at suitable positions thereof, said shape-retaining members being made of an elastomer material sufficiently resilient to maintain the shape of the glove;

a reinforcing member interposed between the outer surface of said rear portion and the shape-retaining members to prevent the glove from bending backwards when catching the ball.

* * * * *